US007543349B2

(12) United States Patent
Coon

(10) Patent No.: US 7,543,349 B2
(45) Date of Patent: Jun. 9, 2009

(54) TROWEL

(76) Inventor: Duane A. Coon, P.O. Box 324, Star, ID (US) 83669

( * ) Notice: Subject to any disclaimer, the term of this patent is extended or adjusted under 35 U.S.C. 154(b) by 934 days.

(21) Appl. No.: 10/788,213

(22) Filed: Feb. 27, 2004

(65) Prior Publication Data

US 2005/0188492 A1 Sep. 1, 2005

(51) Int. Cl.
*B05C 17/10* (2006.01)
*E01C 19/12* (2006.01)

(52) U.S. Cl. ..... 15/235.4; 15/235.7

(58) Field of Classification Search ..... 15/235.4, 15/235.7; D8/10, 45

See application file for complete search history.

(56) References Cited

U.S. PATENT DOCUMENTS

| | | | | | |
|---|---|---|---|---|---|
| 1,168,643 | A * | 1/1916 | Johnson | 15/235.4 |
| 2,906,115 | A * | 9/1959 | Pastoret | 15/235.4 |
| D384,251 | S * | 9/1997 | Yeh | D8/10 |
| D459,957 | S * | 7/2002 | Lin | D8/10 |
| 6,604,256 | B1 * | 8/2003 | Pytlewski | 15/235.4 |

* cited by examiner

*Primary Examiner*—John Kim
*Assistant Examiner*—Laura C Cole

(57) ABSTRACT

An invention that uses a convex shaped tool in the application and smoothing of concrete, but also can be used in other fields where needed where there is a concave surface. This trowel will be a big help in many variety of fields that has to deal with different degrees of concave surfaces. This trowel has a need to come in many different sizes, convex shapes, and composition depending on the need in the desired job being worked on. This trowel will be a big help in areas of concave surfaces where before there was no universal tool to do those jobs quickly and efficiently.

2 Claims, 2 Drawing Sheets

TROWEL

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not Applicable.

OBJECTS OF THE INVENTION

No longer applies.

SEQUENCE LISTING

Not Applicable.

BACKGROUND OF THE INVENTION

1. Field of the Invention

The subject invention relates to a trowel that has a convex shape. The convex shape applies to both the float trowel and finishing trowel. The convex shape of these tools allows a person to do virtually any concrete job application that has a concave surface.

2. Prior Art

Concrete trowels are used to spread and set up a concrete surface like a sidewalk, road, foundation, curbs, pools etc. and then a finishing trowel is than used to get the smooth finish and the sealing of the concrete. All trowels are flat with some variations as in length, width, square or rounded ends, or they are a specific shape like a concrete edger for the 90 degree curbwork. The pool trowel having rounded ends won't cut into concrete like a square trowel will and is used for gradual concave surfaces like a swimming pool, or a sweeping roadside curb the design of the convex trowel is like no other trowel in excistance at this time, so there is no prior art to speak of.

The convex structure of this trowel can still do some of the jobs the other types of trowels can do, but with the shape of this tool it allows much tighter concave surfaces to be handled. For instance, front yard ponds if made out of concrete are very hard to get a smooth surface and a sealing on the surface because all existing trowels and pool trowels cannot handle the tight concave surfaces without marring the surface up in the process. The convex trowel furnishes a way to do these tight concave surfaces smoothly and efficiently while also allowing a smooth surface to be applied without cutting into the surface being worked on.

BRIEF SUMMARY OF THE INVENTION

The novel construction of the invention allows the majority of concave surfaces to be prepared, smoothed if needed and sealed. Some examples of these concave surfaces could be in curbs, pools, ditches, ponds, etc. in varying degrees. Different sizes of the trowel and adjustments on the angles in the convex trowel can help in doing tighter surfaces or more gradual surfaces depending on its need. With a bigger or longer tool you can do a more gradual application.

With the convex shape of this tool you will not be marring your job application with cuts into your surface area because there is no sharp end of the trowel to cut into your material with. Flat trowels and pool trowels when up against tighter concave surfaces will tend to cut into your surface since their design was not for such surfaces. This tool is to solve the problem of not being able to create a smooth concave surface.

DETAILED DESCRIPTION OF THE INVENTION

The convex trowel is a new design in the concrete trowel field. The whole point of the design of this trowel is centered on its convex shape. The convex shape allows a person with any variation of this tool to be able to work with concave concrete surfaces in greater and lesser degrees. Variations of this tool can be as simple as being longer, shorter, wider, lesser or greater angles in the convex of its shape. An example of an invention of many different shapes is the wheelbarrow. The convex trowel can be made in a variety of sizes and shapes, as long as it keeps its overall convex shape. One example of this trowel is in FIG. 1 and FIG. 2 in the attached drawings.

Figure 1:
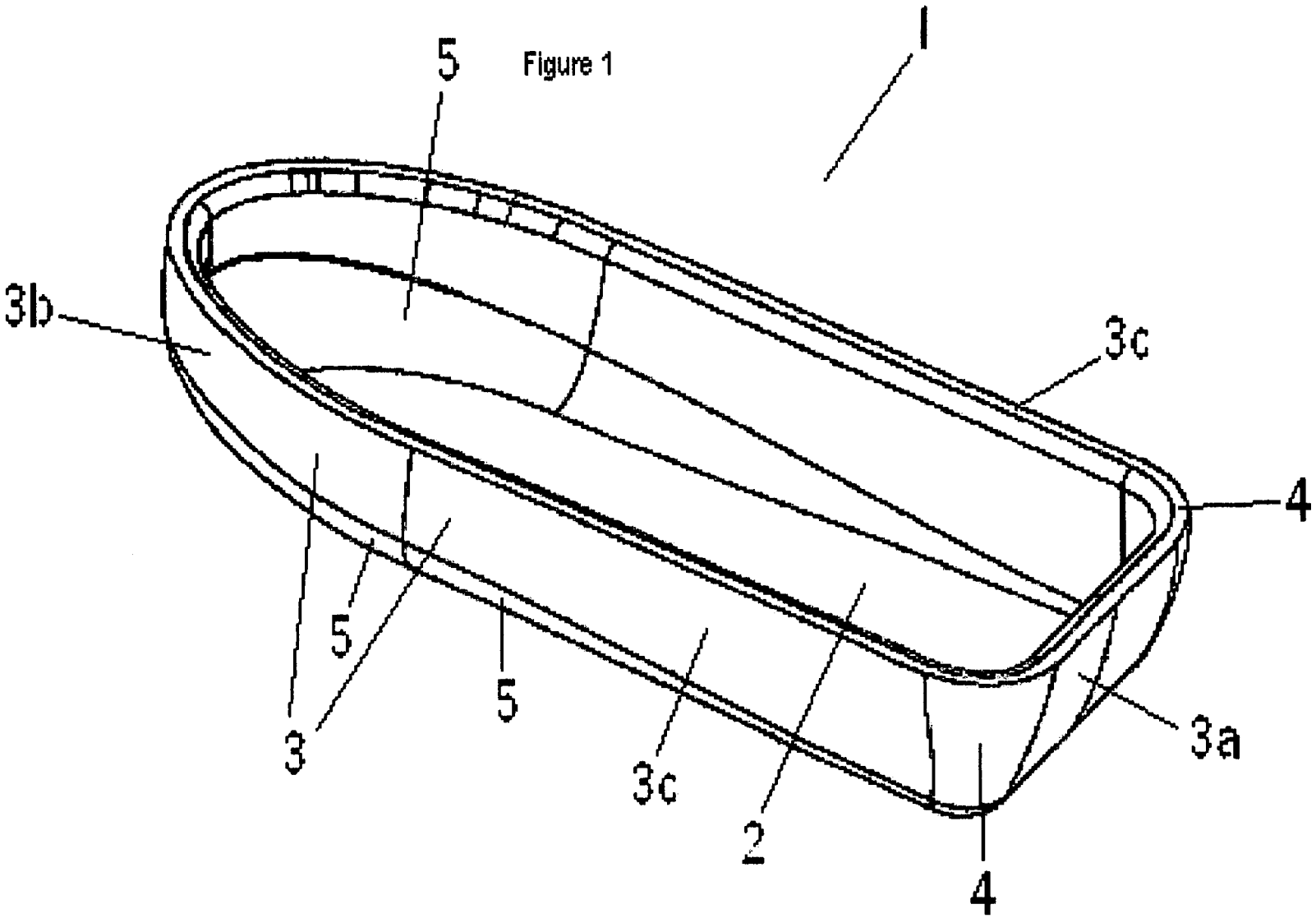
FIG. 1 is a top perspective view of a typical convex trowel.
Figure 2:
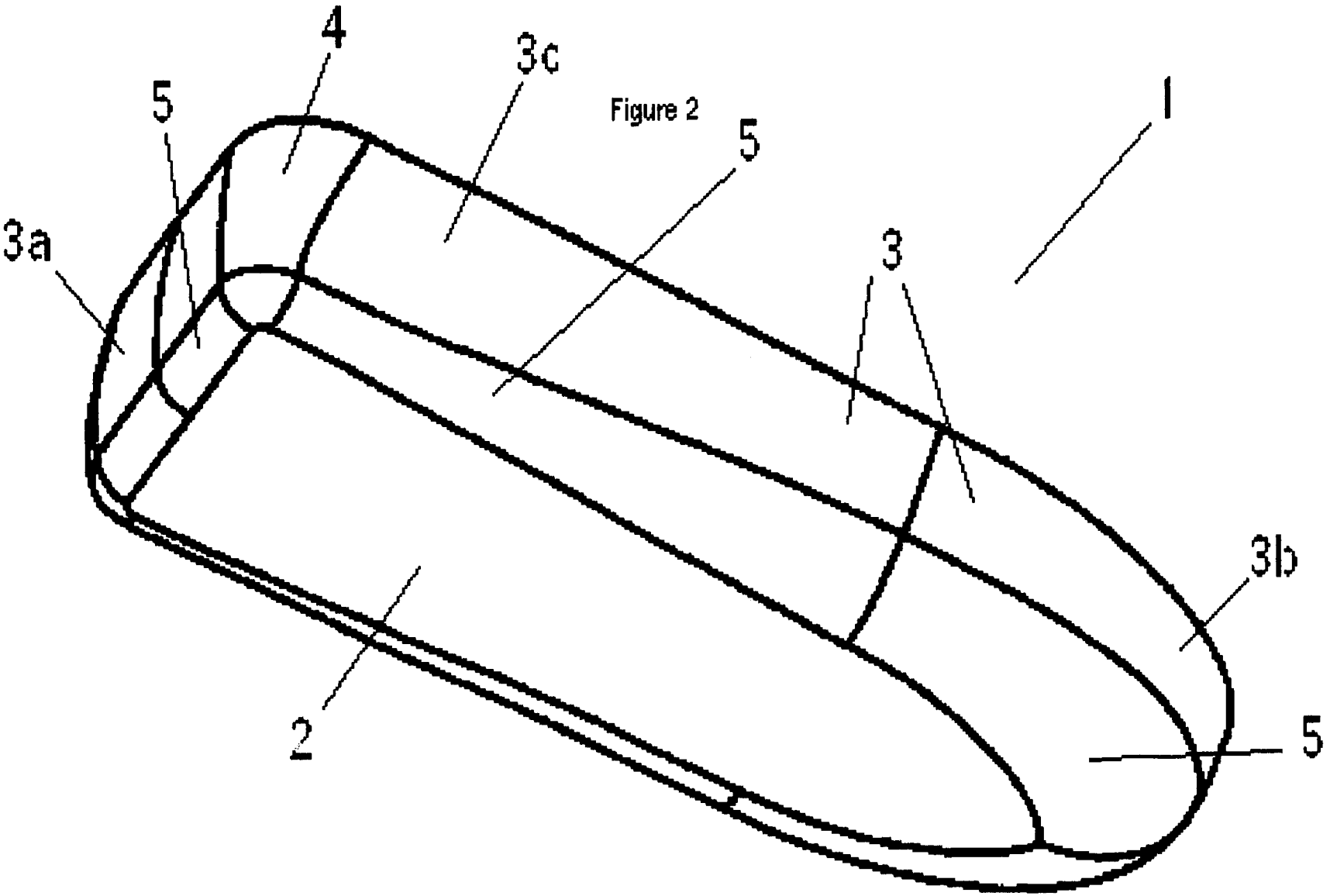
FIG. 2 is a bottom perspective view of a typical convex trowel.

As shown in FIGS. 1 and 2, the finishing trowel or float includes a body (1) defined by a substantially flat planar bottom surface (2) and a peripheral side (3) upstanding from the bottom surface thereby defining a hollow chamber, the peripheral side (3) is continuous and comprises of a first substantially flat side member (3*a*) at a first longitudinal end of the body, an arcuately tapered side member (3*b*) at a second longitudinal end of the body, and two additional substantially flat side members (3*c*) that extend longitudinally between the first flat side member and the tapered side member and are in a substantially parallel relationship, and at a portion where one end of each of the flat side members in parallel relationship joins the first flat side member there is an arcuate junction (4), and wherein there is a convex radius edge (5) at an intersection between the bottom and peripheral sides configured so that a user may finish a concave surface. Additionally, the float or finishing trowel may comprise of metal, plastic, wood, or any other suitable material needed in a desired concrete application.

What is claimed is:

1. A float or finishing trowel comprising of:

a body defined by a substantially flat planar bottom surface and a peripheral side upstanding from the bottom surface thereby defining a hollow chamber, the peripheral side is continuous and comprises of one first substantially flat side member at a first longitudinal end of the body, an arcuately tapered side member at a second longitudinal end of the body, and two additional substantially flat side member that extend longitudinally between the first flat side member and the tapered side member and are in a substantially parallel relationship, and at a portion where one end of each of the flat side members in parallel relationship joins the first flat side member there is an arcuate junction, and wherein there is a convex radius edge at an intersection between the bottom surface and the peripheral side configured so that a user may finish a concave surface.

2. The float or finishing trowel of claim 1, wherein the body comprises metal, plastic, or wood.

* * * * *